US011047646B2

(12) United States Patent
Libotte

(10) Patent No.: US 11,047,646 B2
(45) Date of Patent: Jun. 29, 2021

(54) TELESCOPIC SIGHT

(71) Applicant: FN Herstal S.A., Herstal (BE)

(72) Inventor: Hugues Libotte, Jalhay (BE)

(73) Assignee: FN HERSTAL S.A., Herstal (BE)

( * ) Notice: Subject to any disclaimer, the term of this patent is extended or adjusted under 35 U.S.C. 154(b) by 185 days.

(21) Appl. No.: 16/317,275

(22) PCT Filed: Jul. 11, 2017

(86) PCT No.: PCT/EP2017/067428
§ 371 (c)(1),
(2) Date: Jan. 11, 2019

(87) PCT Pub. No.: WO2018/011218
PCT Pub. Date: Jan. 18, 2018

(65) Prior Publication Data

US 2020/0386518 A1 Dec. 10, 2020

(30) Foreign Application Priority Data

Jul. 15, 2016 (BE) ..... 2016/5595

(51) Int. Cl.
*F41G 1/38* (2006.01)
*F41G 1/44* (2006.01)
*F41G 1/48* (2006.01)

(52) U.S. Cl.
CPC ..... *F41G 1/38* (2013.01); *F41G 1/44* (2013.01); *F41G 1/48* (2013.01)

(58) Field of Classification Search
CPC ..... F41G 1/38; F41G 1/40; F41G 1/44; F41G 1/48; F41G 1/50
See application file for complete search history.

(56) References Cited

U.S. PATENT DOCUMENTS 2,694,869 A * 11/1954 McNatt ..... F41G 3/2694 434/19
3,339,450 A * 9/1967 Reed ..... G02B 23/14 356/254

(Continued)

FOREIGN PATENT DOCUMENTS

EP 0124682 A1 11/1984
EP 1688761 A1 8/2006
WO WO 2016/097992 A1 6/2016

OTHER PUBLICATIONS

International Search Report in International Application No. PCT/EP2017/067428 dated Sep. 15, 2017.

*Primary Examiner* — Joshua T Semick
(74) *Attorney, Agent, or Firm* — Leydig, Voit & Mayer, Ltd.; Gerald T. Gray

(57) ABSTRACT

The present invention relates to a telescopic sight for a firearm for firing in a downward arc comprising: —a first movable mirror defining a first optical axis, the angle of said first movable mirror being adjustable so as to transmit, during use, the image of a target at an angle of 90°−α with respect to the axis of the barrel of the firearm, α being the desired angle of elevation for a given shot; —an objective lens, on the first optical axis; —a second mirror at 45° with respect to the first optical axis, defining a second optical axis that is parallel to the axis of the barrel of the firearm; —an ocular lens on the optical pathway defined by the mirrors projecting the image of the target to infinity.

12 Claims, 2 Drawing Sheets

(56) References Cited

U.S. PATENT DOCUMENTS

| | | | | | |
|---|---|---|---|---|---|
| 3,694,095 | A * | 9/1972 | Louthan | G02B 17/02 | 356/255 |
| 3,712,702 | A * | 1/1973 | Schmidt | G02B 23/12 | 313/524 |
| 5,140,151 | A * | 8/1992 | Weiner | G02B 23/12 | 359/226.2 |
| 5,530,246 | A | 6/1996 | Hawkins | | |
| 5,619,378 | A * | 4/1997 | Schwab | G02B 23/10 | 359/428 |
| 5,946,132 | A * | 8/1999 | Phillips | G02B 23/12 | 359/350 |
| 6,061,945 | A * | 5/2000 | Wallace | F41G 1/38 | 42/124 |
| 7,768,703 | B2 * | 8/2010 | Winker | F41G 1/38 | 359/432 |
| 7,827,723 | B1 * | 11/2010 | Zaderey | F41G 1/473 | 42/122 |
| 8,375,620 | B2 * | 2/2013 | Staley, III | F41G 1/52 | 42/142 |
| 8,578,646 | B2 * | 11/2013 | Joannes | F41G 1/30 | 42/113 |
| 8,733,647 | B2 * | 5/2014 | Roider | F41G 1/473 | 235/404 |
| 9,115,958 | B2 * | 8/2015 | Crispin | F41G 1/38 | |
| 9,383,168 | B2 * | 7/2016 | Stokes | F41G 3/06 | |
| 9,910,259 | B2 * | 3/2018 | Armbruster | G02B 27/42 | |
| 2015/0068098 | A1 | 3/2015 | Stokes et al. | | |
| 2016/0169621 | A1 * | 6/2016 | Geva | F41G 3/06 | 42/118 |

* cited by examiner

TELESCOPIC SIGHT

SUBJECT OF THE INVENTION

The present invention relates to a telescopic sight for parabolic shots.

PRIOR ART

It is known to use a telescopic sight to improve the precision of firearm shots. In the case of conventional targeting systems, the vertical deviation of the projectile is taken into account by introducing a slight angle, in the vertical plane, between the axis of the telescopic sight and the axis of the barrel of the firearm. This solution is adequate for shots using rapid munitions for which the trajectory is flat. Specifically, in this case, the required angle remains small, of about a few degrees. This angle is generally adjusted by means of a screw and a hinge, allowing a very fine adjustment (fraction of a degree).

In the case of shots with munitions for which the initial angle of elevation required for a given range is large, such as for example for grenade launchers, the modification in the angle between the barrel and the telescopic sight is such that adjustment via an adjusting screw becomes impractical. For angles larger than 5 or 10°, the adjustment becomes tedious and inadequate under real engagement conditions.

Systems allowing a rapid adjustment, for example by means of a lockable sliding guide that replaces the adjusting screw, have thus been developed. Nevertheless, these systems are imprecise. Moreover, the movement of the entire telescopic sight also causes mechanical problems, leading to a system of low robustness.

Document WO 2016/097992 describes a telescopic sight for parabolic shots comprising various mirrors; nevertheless, it does not allow a direct view to be simultaneously kept through the telescopic sight and outside of the telescopic sight, this possibly causing difficulties during initial aiming, above all at high magnifications, at which the field of view in the telescopic sight is small.

SUMMARY OF THE INVENTION

The present invention relates to a telescopic sight for a firearm and for parabolic shots, comprising:

- a first movable mirror defining a first optical axis, the angle of said first movable mirror being adjustable so as to steer in use the image of a target by an angle of 90°−α with respect to the axis of the barrel of the firearm, a being the desired difference between the angle of elevation and the angle of sight for a given shot;
- an objective lens, on the first optical axis;
- a second mirror at 45° to the first optical axis, defining a second optical axis parallel to the axis of the barrel of the firearm;
- either an eyepiece lens on the optical path defined by the mirrors projecting the image of the target to infinity, or means for recording the image projected by the objective lens.

By parabolic shot, what is meant in the present description is a shot for which the difference between the angle of elevation of the target and the angle of elevation for the shot is larger than 10°.

According to preferred embodiments of the invention, the telescopic sight of the invention comprises at least one, or a suitable combination, of the following features:

- the telescopic sight comprises a third mirror at 45° to the second optical axis, defining a third optical axis parallel to the first optical axis and a fourth mirror that steers, in use, the third optical axis toward the eye of the shooter;
- the fourth mirror is movable and the movement of which is mechanically or electronically slaved to the movement of the first movable mirror, so as to keep an angle of 90° between these two mirrors, so that the angle of sight through the telescopic sight corresponds to the angle of sight outside of the telescopic sight;
- the fourth mirror is securely fastened to the first movable mirror;
- the first and fourth mirrors are two reflective faces of the same prism;
- at least one of the mirrors is a semi-transparent mirror, a point light source or a reticle being placed in a plane conjugated with the focal plane of the eyepiece lens by means of a focusing lens, the focusing lens being located in the extension of the optical axis upstream of the at least one semi-transparent mirror, so as to appear, in use, superposed on the image of the target;
- the lateral position of the point light source or of the reticle is adjustable laterally, so as to allow a correction of the azimuthal deviation due to the Magnus effect and/or to a cant angle different from zero;
- the telescopic sight comprises an inclinometer that measures the cant angle of the firearm and an optical display suitable for projecting indications from a plane that is optically conjugate with the focal plane of the eyepiece lens, said optical display indicating, in use, when the cant angle has a predetermined value;
- the predetermined non-zero cant angle is set beforehand depending on the shooting distance and on the Magnus effect of a particular munition, the cant angle correcting for the Magnus effect;
- at least one of the mirrors is a semi-transparent mirror, an illuminating light source being located in the extension of the optical axis downstream of the at least one semi-transparent mirror, so as, in use, to illuminate the target via the first movable mirror, said light source being placed so as to obtain as output from the objective lens a beam of plane waves;
- the telescopic sight comprises an optical device for erecting the image;
- the telescopic sight comprises means for adjusting the first movable mirror, which makes an angle of elevation α correspond to a shooting distance;
- said means for adjusting the first movable mirror comprise an adjusting wheel graduated in m, said adjusting wheel adjusting the angular position of the first movable mirror;
- said means for adjusting the first movable mirror comprise a ballistic table and a computer connected to a rangefinder, said computer controlling in use an actuator that adjusts the angular position of the movable mirror depending on the measured range and on the ballistics of the munition used.

REFERENCE NUMBERS OF THE FIGURES

Figure 1:
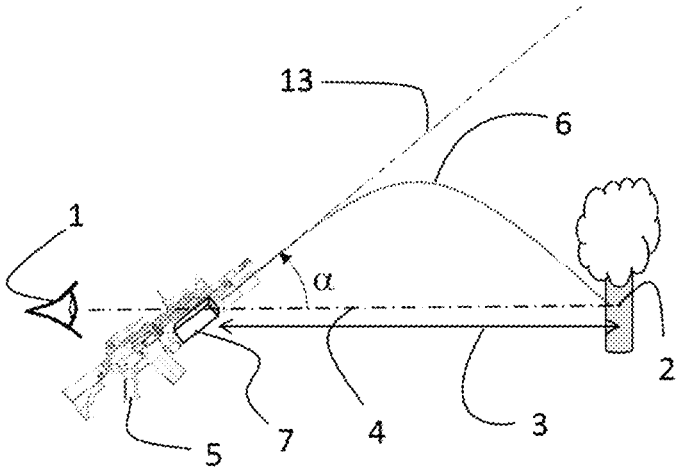
FIG. 1 shows the general parameters of a parabolic shot using a targeting system according to the invention.

1. User
2. Target
3. Shooting distance
4. Axis of sight
5. Firearm
6. Trajectory
7. Telescopic sight
13. Bore axis
14. Housing
15. (Transparent) front window
16. (Transparent) rear window
30. Reticle (red dot) light source
31. Lens for focusing the reticle
32. Display screen
60. First movable mirror
61. Objective lens
62. First steering mirror
63. Eyepiece lens
65. Illuminating light source
66. Optical axis of the objective lens
67. Optical axis of the eyepiece lens
68. Second steering mirror
69. Second movable mirror
70. Movable prism
75. Axis of the movable prism

DETAILED DESCRIPTION OF THE INVENTION

The idea behind the invention is to replace movement of the whole telescopic sight with movement of a movable mirror 60, allowing the line of sight 4 to be modified with respect to the axis of the barrel 13 without moving the optical elements of the telescopic sight. All of the elements of the telescopic sight of the invention may thus advantageously be placed in a fixed housing 14, thereby increasing the robustness of the system.

Preferably, the housing 14 is made seal-tight by the presence of a front window 15 and of a rear window 16. In this way, all of the elements of the telescopic sight, including the movable elements, are protected from outside elements (moisture, dirt, etc.), this making the device particularly robust in aggressive environments (sandstorms, rain, snow, etc.).

Figure 3:
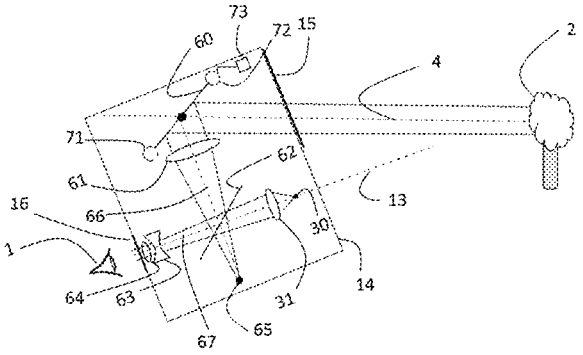
FIGS. 3 to 6 show examples of telescopic sights according to the invention.

FIG. 3 shows the simplest embodiment of the invention, which may comprise additional elements of the other embodiments, such as will become clear below. In this embodiment, the axis of sight of the user 1 remains parallel to the axis of the firearm.

The position of the first movable mirror 60 is adjusted via a firing table that, makes an angle of elevation $\alpha$ correspond to a shooting distance 3. This firing table may for example take the form of an adjusting wheel 71 graduated in m (meters), said adjusting wheel adjusting the angular position of the first movable mirror 60.

Alternatively, the telescopic sight comprises means for adjusting the first movable mirror 60, comprising a ballistic table and a computer 73 connected to a rangefinder, said computer 73 controlling an actuator 72 that adjusts the angular position of the movable mirror 60 depending on the measured range and on the ballistics of the munition used.

According to the invention, the movable mirror 60 steers the line of sight 4 toward an objective lens 61 that interacts with an eyepiece lens 63 in order to deliver an enlarged image of the targeted scene 2 to the user 1. In order to keep the gaze of the user 1 along the axis 13 of the barrel, the device advantageously comprises a steering device such as a mirror 62 or a prism.

Alternatively, in particular for remotely guided systems, the eyepiece lens 63 may be replaced by recording means such as a CMOS or CCD photographic sensor. In this case, the image formed by the objective lens 61 is formed on the sensor and delivered by suitable communication means to a screen, for example in a control room, or to a control console of the remotely controlled weapon system.

The eyepiece lens 63 may advantageously be a divergent lens defining what is called a Galilean geometry, which has the advantage of producing an upright image of the distant object. This eyepiece lens may be a single lens or comprise an achromatic assembly, such as an achromatic doublet or triplet.

In the case of a convergent eyepiece lens, defining what is called a Keplerian geometry, the inverted image may advantageously be erected by means of a suitable optical device 64, such as an additional lens, or a prism-based erecting device (Porro prism, Abbe-Koenig prism, etc.).

Advantageously, the telescopic sight of the invention comprises a movable red dot that is superposed on the target during aiming. This red dot is preferably obtained with an almost point-like light source 30 located in the extension of the optical axis of the eyepiece, behind the steering device. The latter will then possibly comprise a semi-transparent mirror 62 or a beamsplitter cube formed from two prisms (not shown). The device then has the advantage that the movable red dot remains aligned on the target without having to move it. In order to be perceived by the user clearly, the light source 30 is located in a plane conjugated with the focal plane of the eyepiece. This conjugation may for example be obtained using a lens 31.

The light source may either be formed by a point source such as an LED of small size, it may comprise a pinhole controlling its size, or even form part of a luminous screen 32 of good resolution (LED screen, OLED screen, backlit LCD, etc.). In the latter case, other information may be communicated to the user, by superposing the image of the screen on the image of the target. Such as will be seen below, this display will possibly for example be used to indicate cant angle to the user.

The telescopic sight of the invention also preferably comprises a designating/illuminating device that illuminates the target or produces a light spot on the latter. This illumination is preferably achieved by means of light outside of the visible wavelengths and seen for example by means of night-vision goggles. An example of non-visible wavelengths is the use of the near infrared (IR). Suitable power IR lasers are preferably used.

To illuminate/designate the target, an illuminating light source 65 of suitable wavelength is placed in the extension of the optical axis of the objective lens 61, behind the steering device 62. Thus, in this case the steering device will have to allow both the image of the target to be steered toward the eyepiece 63 and the illuminating beam to be transmitted. This steering device thus also comprises a semi-transparent mirror 62 or a beamsplitter cube formed from two prisms (not shown). Once again, the advantage of the device is that it allows this source to be kept immobile.

This time, the illuminating light source 65 is located in the focal plane of the objective lens 61, or in a plane conjugated therewith.

When it is desired both to designate the target and to superpose a red dot/reticle, the same semi-transparent mirror 62 may advantageously be used, such as shown in FIG. 3.

Lastly, when the Magnus effect is to be taken into account, the luminous red dot and the designating beam may advantageously be moved to correct the azimuthal direction by laterally moving the corresponding light sources in their respective conjugated planes.

Figure 2:
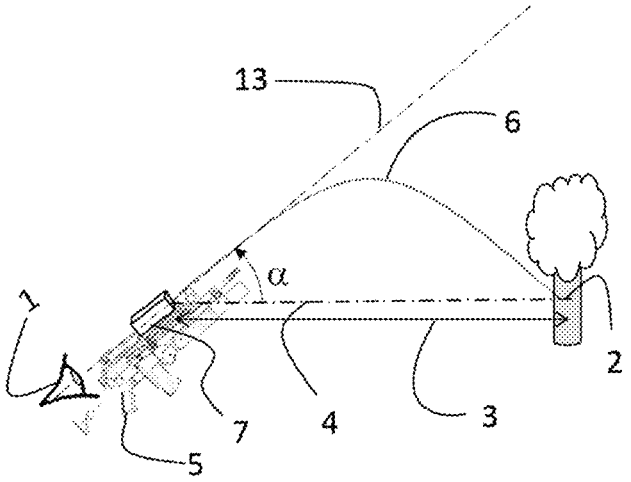
FIG. 2 shows the general parameters of a parabolic shot using another targeting system according to the invention.
Figure 4:
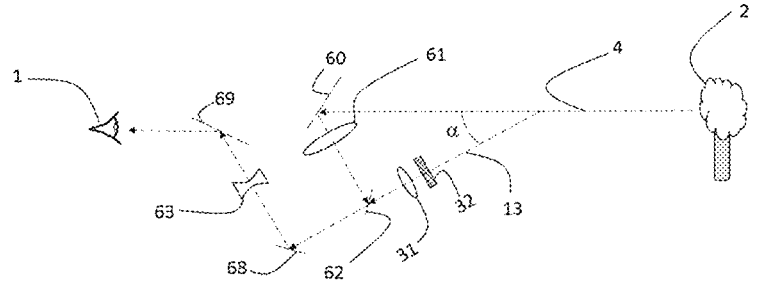

In certain cases, it may be more comfortable for the user for the axis of sight of the user to remain aligned with the target such as shown in FIG. 2. A device allowing such an effect is shown in FIG. 4. In this case, a second fixed steering device 68 is added on the optical path of the telescopic sight, which steers the image toward a second movable mirror 69 that steers the image of the target toward the eye of the user. This second movable mirror 69 is slaved to the first mirror 60 so as to keep an angle of 90° therebetween, so as to keep the axis of sight of the user pointed toward the target.

Advantageously, the two reflective surfaces are slaved using a prism 70 that rotates about an axis 75. Such a device is shown in FIGS. 5 and 6.

It will be noted that in all the presented cases, an elevation of an angle $\alpha$ will be obtained by rotating the movable mirror 60 or the prism 70 by an angle $\alpha/2$.

Figure 5:
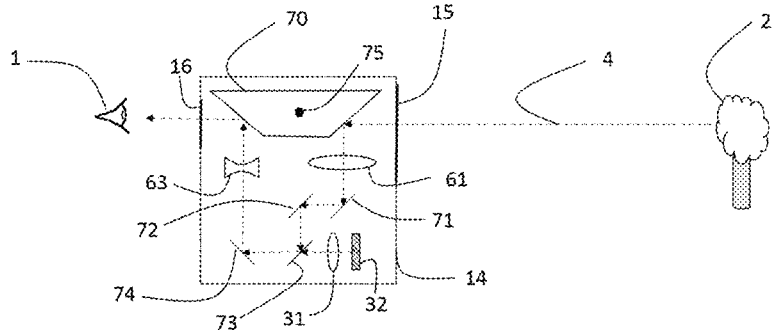
Figure 6:
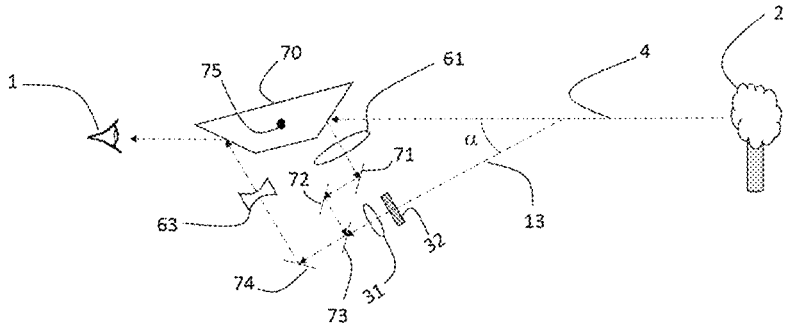

In order to decrease the bulk due to the illuminating and/or red-dot light sources, it may prove to be useful to provide additional steering devices, such as shown in FIGS. 5 and 6, in which the steering mirror 62 has been replaced by the mirrors 71, 72 and 73.

Advantageously, the telescopic sight of the invention comprises an inclinometer that measures the cant angle of the firearm and an optical display by means of indications projected from a plane that is optically conjugated with the focal plane of the eyepiece lens, the optical display indicating when the cant angle is zero.

Preferably, depending on the distance of the target, a cant angle correcting for the Magnus effect is determined, the optical display indicating to the user when this cant angle is achieved.

The invention claimed is:

1. A telescopic sight for a firearm and for parabolic shots, comprising:

a first mirror defining a first optical axis, the angle of said first mirror being adjustable so as to steer in use an image of a target by an angle of 90°−$\alpha$ with respect to an axis of a barrel of the firearm, a being an angle of elevation desired for a given shot;

an objective lens, on the first optical axis;

a second mirror at 45° to the first optical axis, defining a second optical axis parallel to the axis of the barrel of the firearm;

either an eyepiece lens on an optical path defined by the first and second mirrors projecting the image of the target to infinity, or means for recording the image projected by the objective lens;

a third mirror at 45° to the second optical axis, defining a third optical axis parallel to the first optical axis;

a fourth mirror that steers, in use, the third optical axis toward an eye of a shooter, the fourth mirror being movable, and its movement being mechanically or electronically slaved to a movement of the first mirror, so as to keep an angle of 90° between the fourth and first mirrors, so that an angle of sight through the telescopic sight corresponds to an angle of sight outside of the telescopic sight.

2. The telescopic sight as claimed in claim 1, wherein the fourth mirror is securely fastened to the first mirror.

3. The telescopic sight as claimed in claim 2, wherein the first and fourth mirrors are two reflective faces of the same prism.

4. The telescopic sight as claimed in claim 1, wherein at least one of the first, second, third or fourth mirrors is a semi-transparent mirror, a point light source or a reticle being placed in a plane conjugated with a focal plane of the eyepiece lens by means of a focusing lens, the focusing lens being located in the extension of the optical axis upstream of the at least one semi-transparent mirror, so as to appear, in use, superposed on the image of the target.

5. The telescopic sight as claimed in claim 4, wherein a lateral position of said point light source or of the reticle is adjustable laterally, so as to allow a correction of the azimuthal deviation due to the Magnus effect and/or to a cant angle different from zero.

6. The telescopic sight as claimed in claim 1, further comprising an inclinometer that measures a cant angle of the firearm and an optical display by means of indications projected from a plane that is optically conjugated with the focal plane of the eyepiece lens, said optical display indicating when the cant angle has a predetermined non-zero value.

7. The telescopic sight as claimed in claim 6, wherein the predetermined non-zero value of the cant angle is preset depending on a shooting distance and on the Magnus effect of a particular munition, the cant angle correcting for the Magnus effect.

8. The telescopic sight as claimed in in claim 1, wherein at least one of the first, second, third or fourth mirrors is a semi-transparent mirror, an illuminating light source being located in an extension of the optical axis downstream of the at least one semi-transparent mirror, so as, in use, to illuminate the target via the first mirror, said light source being placed so as to obtain as output from the objective lens a collimated beam of plane waves.

9. The telescopic sight as claimed in claim 1, further comprising an optical device for erecting the image.

10. The telescopic sight as claimed in claim 1, further comprising means for adjusting the first mirror, which makes an angle of elevation angle $\alpha$ correspond to a shooting distance.

11. The telescopic sight as claimed in claim 10, wherein said means for adjusting the first mirror comprise an adjusting wheel graduated in meters, said adjusting wheel adjusting the angular position of the first mirror.

12. The telescopic sight as claimed in claim 10, wherein said means for adjusting the first mirror comprise a ballistic table and a computer connected to a rangefinder, said computer controlling in use an actuator that adjusts an angular position of the first mirror depending on a measured range and on ballistics of a munition used.

* * * * *